United States Patent [19]

Steele

[11] 4,359,976

[45] Nov. 23, 1982

[54] COMPRESSION COMPENSATOR

[76] Inventor: Harry C. Steele, 2625 Algonquin Ave., Ashland, Ky. 41101

[21] Appl. No.: 160,240

[22] Filed: Jun. 17, 1980

[51] Int. Cl.[3] ..... F02B 75/04

[52] U.S. Cl. ..... 123/78 B; 123/193 P; 92/60

[58] Field of Search ..... 123/48 R, 48 B, 78 R, 123/78 B, 193 P; 92/60, 60.5

[56] References Cited

U.S. PATENT DOCUMENTS 1,508,099 9/1924 Hawley, Jr. ..... 123/78 B
1,605,838 11/1926 Hawley, Jr. ..... 123/78 B

FOREIGN PATENT DOCUMENTS 1153247 3/1958 France ..... 123/78 B
1303526 8/1962 France ..... 123/78 B

*Primary Examiner*—Craig R. Feinberg
*Assistant Examiner*—W. R. Wolfe
*Attorney, Agent, or Firm*—John W. Huckert

[57] ABSTRACT

A compression compensator for an internal combustion engine comprising a flexible disc of high heat resistant spring material is secured to the top of each of the engine pistons. In addition, a spiral spring may be placed between the disc and the piston top to increase the flexibility and resilience of the compensator.

10 Claims, 7 Drawing Figures

COMPRESSION COMPENSATOR

BACKGROUND OF THE INVENTION

1. Field of the Invention

This invention relates to a compensator structure for use in internal combustion engines which serves to increase the compression ratio of an engine under low loads and decrease the compression ratio under high power loads.

2. Description of the Prior Art

In the past various devices have been applied to internal combustion engines to change the compression ratio as the load changes. Some of these provide for moving the head of the engine while others provide structure on the piston for effectively changing the size of the piston. Most of these involve mechanical linkages with many moving parts. These create a heavy piston which under prolonged use would soon fly apart.

Existing prior patents which are pertinent to this invention are as follows:

| | | |
|---|---|---|
| P. H. Kuhn | 1,439,109 | Dec. 19, 1922 |
| J. B. Hawley, Jr. | 1,508,099 | Sept. 9, 1924 |
| J. B. Hawley, Jr. | 1,605,838 | Nov. 2, 1926 |
| M. B. Jackson | 1,860,673 | May 31, 1932 |
| W. S. Makaroff | 1,874,561 | Aug. 30, 1932 |
| E. E. Leissner | 2,170,266 | Aug. 22, 1939 |
| P. S. Webster | 2,376,214 | May 15, 1945 |
| R. M. Ickes | 2,791,991 | May 14, 1957 |
| S. T. Etal | 3,205,878 | Sept. 14, 1965 |

SUMMARY OF THE INVENTION

An object of the present invention is to provide a simple, lightweight, corrugated or ribbed compression compensator with relatively no moving parts.

Another object of this invention is to provide a compression compensator which requires no adjusting or changing of engine power for its proper function and operation.

A further object of this invention is to provide a compression compensator which can be used in any type piston engine whether new or old.

The compression compensator is a flexible circular disc so designed that when it is placed in the top of the piston of an internal combustion engine it serves to increase the compression ratio of the engine under low loads and decrease the compression ratio under higher power loads.

The disc is so mounted as to extend further into the combustion chamber and raise the compression ratio. Yet at a given pressure, such as at full power loading, the disc will compress and serve to lower the compression ratio. This prevents knocking and pinging of the engine which results in power loss. Most of the time gas engines are not run at full throttle meaning they are running on a lower compression ratio which results in low efficiency and fuel waste.

The power derived from a fuel charge is in direct proportion to the pressure it is placed under before firing. However this compressive cycle is limited by the detonation resistance ability of the fuel. The compression compensator will allow the engine to run at a higher compression ratio at low or mid throttle settings, giving up to 20% more fuel efficiency while still retaining the ability to lower the ratio for peak power demands. The compensator compresses at the top of the stroke but expands again further down in the cylinder to give an increased power impulse.

The piston top is preferably recessed to allow for the depression and support of the disc. The top is also perforated to allow for air and oil circulation for cooling. Furthermore, a jet of oil can be directed from below toward the piston top for cooling.

The Disc or Diaphram is made from high heat resistant alloy spring material, oval or near oval in shape with flex rings built in to allow compressive or stretch stresses to be absorbed in the disc itself. The rim of the disc is designed for rigidity at the rim or mounting ring. A gasket or gaskets can be mounted under or over the mounting rim. The rim of the disc has a depressed design to receive strength and support from the piston and retaining ring.

The compression compensator can be held in place either by a threaded retaining ring with holes or depressions in the top surface for a mounting wrench, or, by a ring and snap ring or, by a ring held in place by a rolled portion of the piston. Extra material can be provided for this. Or, a split ring may be used. An additional spring may also be used between the inner side of the compensator disc and the top of the piston to increase the overall performance of the compensator.

The advantages of this system are quite obvious. The device is simple and can be used in any piston engine. It requires no adjusting or changing of the engine proper. It can be used in brand new engines, or in old engines as replacement parts.

These, together with other objects and advantages which will become apparent, reside in the details of construction and operation as more fully described and claimed hereinafter, reference being had to the accompanying drawings forming a part thereof, wherein like numerals refer to like parts throughout.

DESCRIPTION OF THE PREFERRED EMBODIMENT(S)

Figure 1:
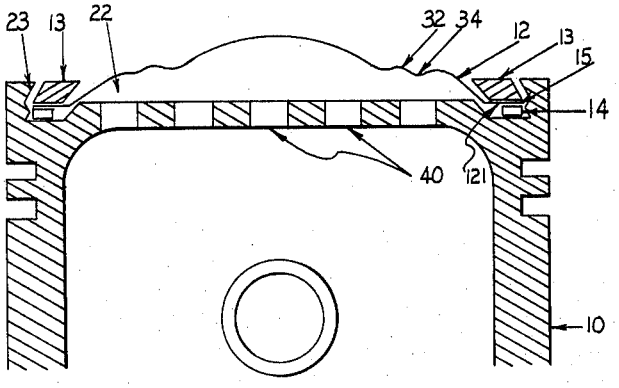
FIG. 1 shows a cross section of a piston constructed for use with a compression compensator disc in accordance with the preferred embodiment of the invention.

Looking at FIG. 1 of the drawing, Reference 10 indicates the piston for an internal combustion engine having the improvement thereon of subject invention. This improvement comprises a flexible circular disc 12 of high heat resistant spring material. A depression 22 is preferably provided in the top of the piston for reception of the disc. The disc preferably is of corrugated configuration having alternating ridges 32 and valleys 34. This is for the purpose of permitting maximum flexibility with greatest strength of the disc. The outer circumference of the disc is normally provided with an extending flange portion 121. This flange portion 121 is secured to the piston in several ways.

As shown in FIG. 1, the flange 121 of the compensator disc is retained in the shaped recess 23 of the piston top by a ring 13 of essentially rhomboid shape in cross section. Under the lower edge 15 of the flange 121 may be placed a gasket 14. Thus the flange 121 of the compensator disc is held between the ring 13 and the gasket 14 and thus securely attached to the top of piston 10.

Figure 2:
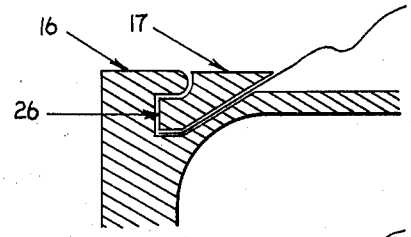
FIGS. 2–4 show various modifications for securing the compensator disc to the piston.

Another ring retention structure is shown in FIG. 2, wherein a specially configured ring 17 is held in place by a rolled portion 16 extending inwardly over the recess 26. Though, a gasket 14 is not shown in this embodiment, such could be used if desired. The ring 17 may either be split somewhere along its circumference, not shown, or may be of sufficient flexibility to permit its deformation and thereby insertion into securing position without being split.

Figure 3:
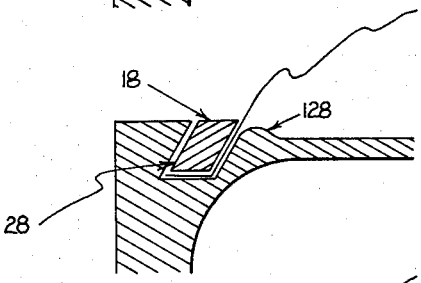

Another embodiment is shown in FIG. 3, wherein the retaining ring 18 is of rhomboid shape in cross section, is preferably split somewhere along its circumference (not shown), and the recess 28 is likewise of basically rhomboid shape. A ridge 128 also may be provided from the edge of the recess to assist in the securement of the compensator disc to the piston head and also increase the effectiveness of the compensator disc in operation.

Figure 4:
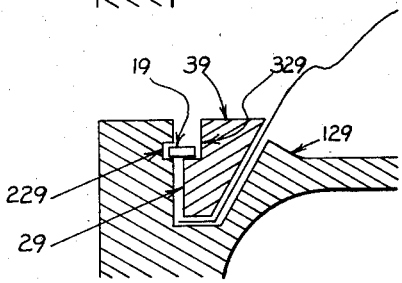

FIG. 4 shows another modification wherein the ring 13 of the version of FIG. 1 is replaced by two rings 19 and 39. The one 39 is normally of the shape shown in cross section, and is of full circular, non-split shape. However, the retaining ring 19 which fits into the groove 229 in the piston head and the complementary recess 329 of ring 39 and thus secures ring 39 in place with recess 29 of the piston top. The ridge 129 extending around the inner circumference of recess 29 of the piston top also functions in the same manner as the ridge 128 of the previous version.

It should also be noted in the showing of FIG. 1 that holes 40 are provided in the top of the piston for the purpose of allowing air and oil to circulate for cooling purposes. Such holes are not shown in FIGS. 2–4, but of course may be provided with these versions also.

Figure 5:
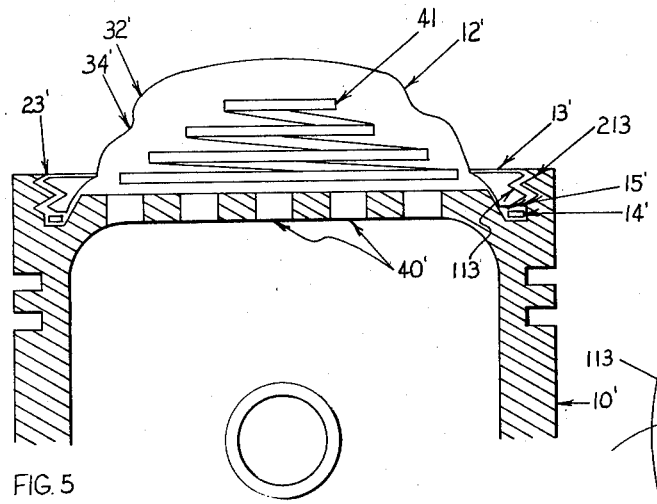
FIG. 5 shows a cross section of the piston of another embodiment similar to the one of FIG. 1, but with the addition of a coil spring between the compensator disc and the piston top.
Figure 6:
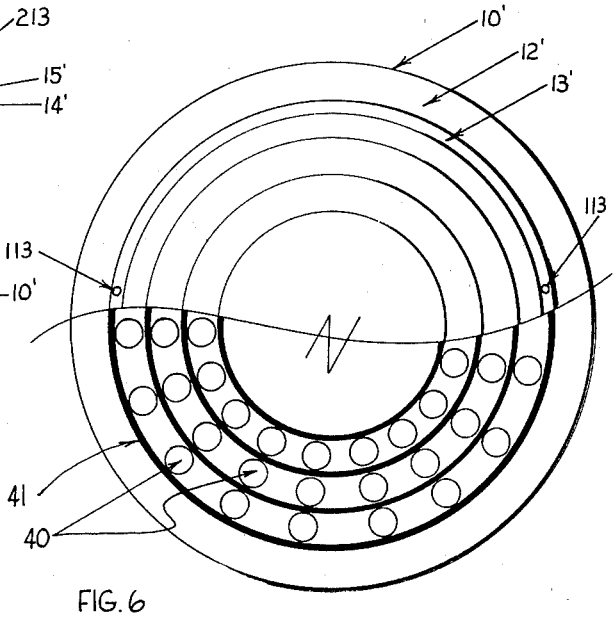
FIG. 6 shows a top plan view with the compensator disc partially cut away to show the cooling holes in the piston top.
Figure 7:
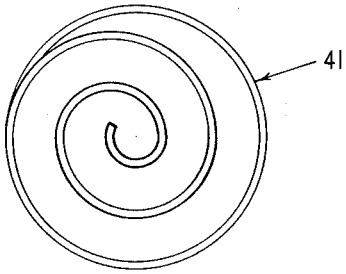
FIG. 7 shows a top view of the coil spring as used with the embodiment of FIG. 5.

In order to give additional strength to the disc 12 and to increase the overall effectiveness during operation thereof, a preferred embodiment of subject invention is shown in FIGS. 5–7. As shown in these figures, a spiral coil spring 41 is placed between the compensator disc 12′ and the top of the piston as best seen in the cross section of FIG. 5. This additional spiral spring permits the disc to be more flexible, and also gives a more uniform resistance to the build-up of pressure in the combustion chamber between the top of the piston as modified with this invention, and the engine head.

In this preferred embodiment, the retaining ring 13′ is also secured to the piston top by means of threads 113 on the ring 13′, which match with complementary mating threads 213 provided within the circumferential recess 23′ of the piston. In this version cooling holes 40′ are also provided.

Also as is best seen in the top plan view of FIG. 6, two engaging apertures 113 diametrically opposite each other are normally provided in the ring 13′ for the purpose of receiving the points of a tool for screwing the ring 13′ into the recess 23′ of the piston. The gasket 14′ is also preferably used with this version of subject invention.

The compression compensator will allow the engine to run at a higher compression ratio at low or mid throttle settings. It will also allow a more advanced spark setting for more power output.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A compression compensator device for use in an internal combustion engine having an engine head and at least one piston with a top comprising: compensator means on the top of said piston for compensating for changes of compression between the top of the piston and the engine head during operation of the engine; detachable means for securing said compensator means to said piston; said compensator means including a circular flexible disc having a corrugated configuration with alternating ridges and valleys; said disc being made of high heat resistant spring material; said detachable means for securing the disc to the piston including a detachable ring structure; a spiral spring being provided between the inner side of the disc and the top of the piston for reinforcing and improving the operation of said disc during engine operation; and said detachable means including ring structure comprises screw threads provided along the outer circumference of said ring, which mate with complementary threads provided along a recessed portion of the piston top for securing said ring thereto.

2. A compression compensator device for use in an internal combustion engine having an engine head and at least one piston with a top comprising: compensator means on the top of said piston for compensating for changes of compression between the top of the piston and the engine head during operation of the engine; detachable means for securing said compensator means to said piston; said compensator means including a circular flexible disc having a corrugated configuration with alternating ridges and valleys; said disc being made of high heat resistant spring material; said detachable means for securing the disc to the piston including a detachable ring structure; a spiral spring being provided between the inner side of the disc and the top of the piston for reinforcing and improving the operation of said disc during engine operation; and cooling holes are provided in the top of said piston underneath said compensator disc for permitting the circulation of air and oil to the compensator disc for the purpose of cooling same.

3. A compression compensator device for use in an internal combustion engine having an engine head and at least one piston with a top comprising:

compensator means on the top of said piston which includes a circular flexible disc for compensating for changes of compression between the top of the piston and the engine head during operation of the engine;

detachable means for securing said compensator means to said piston; and cooling holes provided in the top of said piston underneath said flexible disc for permitting the circulation of air and oil to the disc for the purpose of cooling same.

4. A compression compensator device as set forth in claim 3, wherein said compensator means comprises said circular flexible disc having a corrugated configuration with alternating ridges and valleys thereon.

5. A compression compensator device as set forth in claim 3, wherein said disc is made of high heat resistant spring material, and said detachable means for securng the disc to the piston includes a detachable ring structure.

6. A compression compensator device as set forth in claim 5, wherein said detachable means of detachable ring structure consists of a snap ring securable between a flange provided on the circumference of the compensator disc and a recess provided in the top of said piston.

7. A compression compensator device as set forth in claim 5, wherein said detachable ring structure includes a snap ring having a split along its circumference for permitting easier insertion into a complementary recess provided in the top of the piston.

8. A compression compensator device as set forth in claim 5, wherein said detachable ring structure includes a ring of rhomboid cross section and a recess provided in the top of the piston is also of basically rhomboid shape for mating with said ring.

9. A compression compensator device as set forth in claim 5, wherein said detachable ring structure consists of two complementary ring portions one of which mates with a complementary shaped recess provided in the top of the piston, and is furthermore provided with an L-shaped recess along the outer circumference thereof which complements the second ring which in turn is secured within a groove extending around the circumference of the piston.

10. A compression compensator device as set forth in claim 5, wherein a spiral spring is furthermore provided between the inner side of the compensator disc and the top of the piston for reinforcing and improving the operation of said compensator disc during engine operation.

* * * * *